United States Patent [19]

Monnet

[11] 4,059,957

[45] Nov. 29, 1977

[54] WATER-TIGHT FITTING OF A GLASS IN A WATCH CASE

[75] Inventor: Ferjeux Jean Pierre Monnet, Damprichard, France

[73] Assignee: S.B.B.M. Burdet S.A., France

[21] Appl. No.: 678,662

[22] Filed: Apr. 20, 1976

[30] Foreign Application Priority Data

May 23, 1975 France ..... 75.16208

[51] Int. Cl.[2] ..... G04B 37/08; G04B 39/00

[52] U.S. Cl. ..... 58/90 R; 58/91; 58/94; 58/100

[58] Field of Search ..... 58/90 R, 91, 94, 100

[56] References Cited

U.S. PATENT DOCUMENTS

| | | | |
|---|---|---|---|
| 2,830,434 | 4/1958 | Trautz | 58/91 X |
| 2,989,838 | 6/1961 | Güggi et al. | 58/91 X |
| 3,399,525 | 9/1968 | Caprara | 58/90 R |
| 3,855,786 | 12/1974 | Yamamoto | 58/94 X |
| 3,950,937 | 4/1976 | Fujimori | 58/90 R |

FOREIGN PATENT DOCUMENTS

| | | | |
|---|---|---|---|
| 1,114,244 | 4/1956 | France | 58/91 |

*Primary Examiner*—Stanley J. Witkowski
*Attorney, Agent, or Firm*—Robert E. Burns; Emmanuel J. Lobato; Bruce L. Adams

[57] ABSTRACT

A watch case includes a middle-bezel having a non-circular upper opening receiving a glass of corresponding non-circular shape. The glass has an outwardly-directed peripheral flange able to pass with a slight play through the upper opening in the middle-bezel, and the middle-bezel has an inwardly-directed collar defining its upper opening. A packing seal is disposed with a part under the collar and a part resting on the flange. A screw-fitted circular back applies pressure to the glass to compress the seal between the collar and flange and thereby hold the glass in the upper opening.

6 Claims, 4 Drawing Figures

WATER-TIGHT FITTING OF A GLASS IN A WATCH CASE

BACKGROUND OF THE INVENTION

The invention relates to watch cases of the type including a middle-bezel having a non-circular upper opening receiving a glass of corresponding non-circular shape and a circular lower opening receiving a circular back.

Numerous water-tight cases of this type are known but, in the known cases, the glass is either introduced through the circular opening for the back of the case and its dimensions cannot be greater than the dimensions of this opening, or it is fixed by means of a joint on a shoulder of a bezel, which involves problems regarding water-tightness and securing of the dial and hands as the dial is often larger than the watch movement.

An aim of the invention is to avoid these disadvantages and to permit the use of a dial of large dimensions.

Another aim is to provide a water-tight case of simple constuction enabling an easy fitting of an assembly of a movement, dial and hands.

SUMMARY OF THE INVENTION

The watch case according to the invention is characterized in that the glass has an outwardly-directed peripheral flange dimensioned to be able to pass with a slight play through the upper opening in the middle-bezel, and the middle-bezel has an inwardly-directed collar defining said upper opening, and comprises a packing seal having a part disposed under said collar and a port resting of said flange, and means applying pressure to the glass to compress the seal between said collar and flange and hold the glass in said upper opening.

The accompanying drawings show, by way of example, an embodiment of the invention. In the drawings.

DESCRIPTION OF THE PREFERRED EMBODIMENTS

Figure 2:
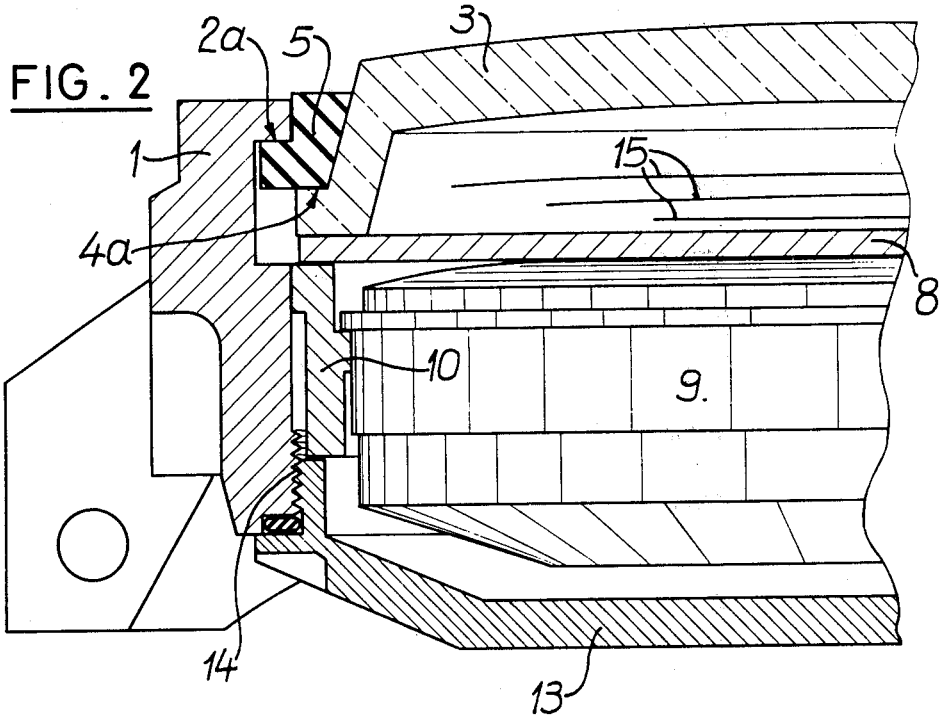
FIG. 2 is a similar view of the assembled case

The watch case shown includes a middle-bezel 1 having at its upper part a non-circular opening 2, receiving a glass 3 having an inclined part 4 which terminates with an outwardly-directed peripheral flange **4*l*. The middle-bezel 1 has at its lower part a threaded circular opening 14 screwably receiving a circular back 13 (FIG. 2). The flange 4*a* of the glass has a peripheral shape and dimensions which correspond, with a slight play, to those of the opening 2 of the middle-bezel 1, so that the glass 3 can be passed through the opening 2**.

The upper opening 2 of middle-bezel 1 is defined by an integral inwardly-directed collar having a shoulder **2*a* at the upper end of a groove 1*a* milled parallel to the plane of the case. This shoulder serves as a bearing for the upper face of a part 5*a* of a packing seal 5 which consists of compressible material such as rubber or synthetic plastic, as shown and as will be described. The middle-bezel of course is rigid. The seal, as shown, has a flat lower face which has an outer edge adjacent to but larger than the circumference of opening 2, and has an inner edge larger than the circumference of opening 2, and has an inner edge also adjacent to but smaller than this circumference. The upper face of flange 4*a* fits under the lower face of the part 5*a* of seal 5**.

Figure 4:
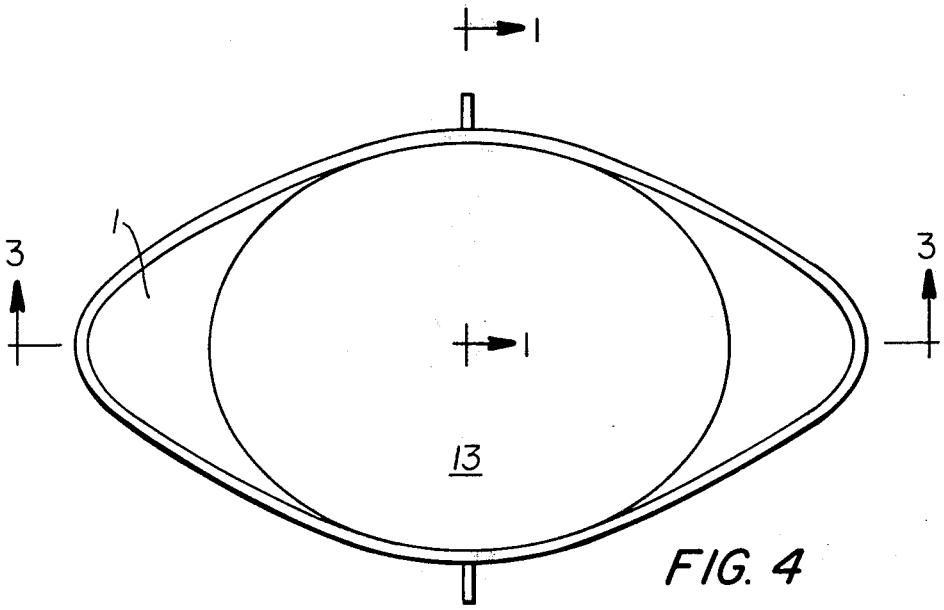
FIG. 4 is bottom view of the complete, assembled case.

A movement-holder ring 10 transmits to the flange **4*a* of the glass a pressure to upwardly press the glass flange 4*a* against an inner part of the seal 5, adjacent to said inner edge, for compress the seal 5 between the shoulder 2*a* of the middle-bezel and the flange 4*a*. In addition to its part 5*a*, which forms an outwardly-directed flange, the seal has an inner part 5*b* having a vertical outer face fitting against the face of opening 2, and an inclined, upwardly converging inner face 5*c*. The inclined part 4 of glass 3 has, extending from the upper face of flange 4*a*, a bevelled, upwardly converging outer face 7 complementary to and generally conforming with face 5*c* of the seal. In this manner, the seal 5 is compressed outwardly against the face of opening 2 and into the groove 1*a* in response to the applied upward pressure, and the glass 3 is hence firmly held in the opening 2. The combined outward and upward compression or pressure is applied to the seal 5 by the glass flange and part 4, 4*a*, through the dial 8 and the ring 10 by screwing the back 13 into a lower, threaded opening 14 of middle-bezel 1; the back 13 being smaller than the middle-bezel, as is shown in FIGS. 2 and 4**.

Figure 1:
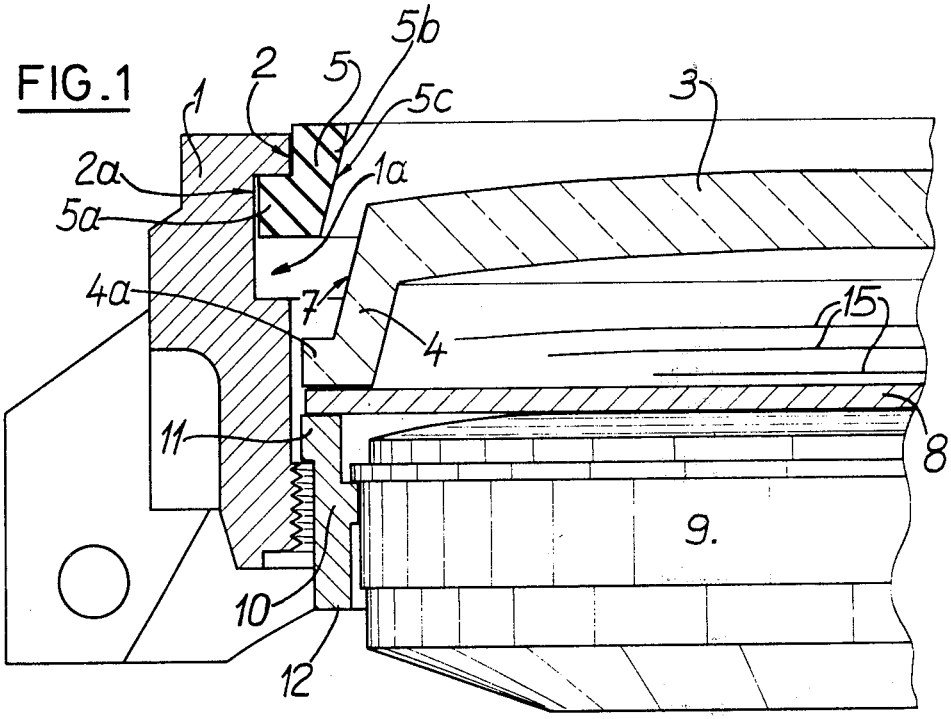
FIG. 1 is a view in partial cross-section taken along line 1—1 in FIG. 4, of a watch case according to the invention, during assembly.
Figure 3:
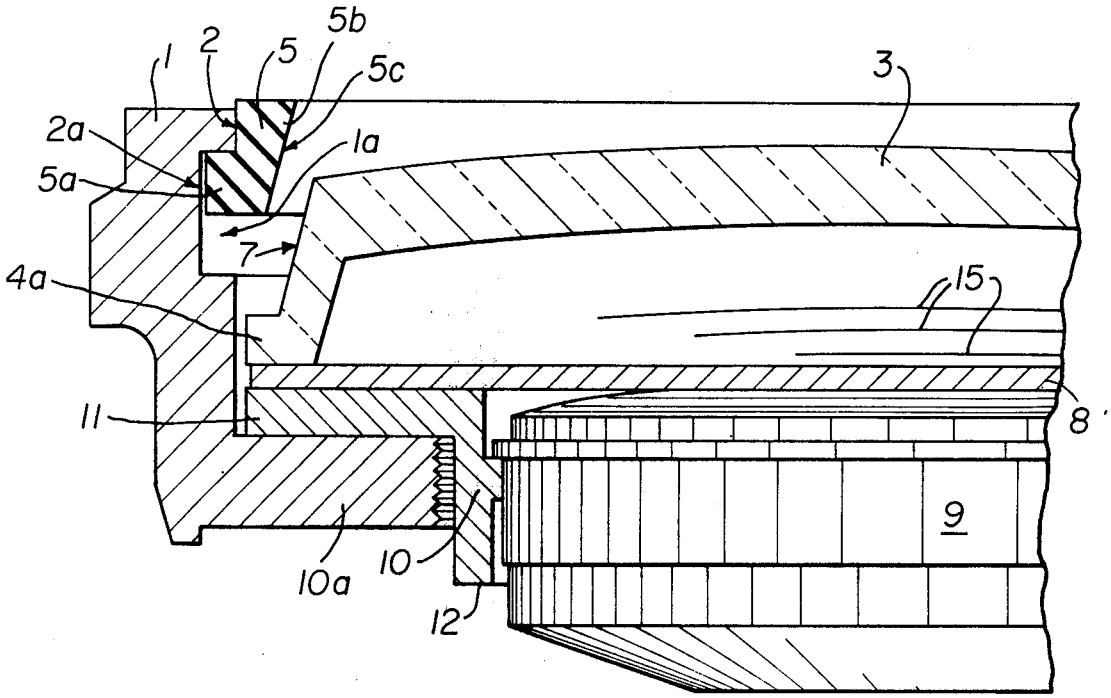
FIG. 3 is another, generally similar view, taken during assembly but along line 3—3 in FIG. 4.

Assembling of the movement and its associated parts in the watch case is very simple:

1. A sub-assembly comprising a movement 9 mounted in the ring 10, a dial 8 and hands 15 is introduced into the middle-bezel 11 through the opening 2. This sub-assembly cannot fall out, as the upper part 11 of ring 10 has the same non-circular shape as the opening 2 and comes to rest on a part **10*a* defining the threaded circular opening 14, whereas its lower part is cylindrical and passes through the opening 14, as shown in FIG. 3**;

2. the glass 3 is placed on the dial 8 then the seal 5 is placed in groove **1*a*, as shown in FIGS. 1 and 3; and finally, 3. the bottom 13 (FIG. 4) is screwed into the lower threaded opening 14 (FIG. 2**).

During this screwing, the upper edge of back 13 pushes the ring 10, which, by the intermediary of dial 8, compresses the seal 5 between the shoulder **2*a* and the upper edge of flange 4*a*, as shown in FIG. 2**.

To dismantle the case, the back 13 is unscrewed and removed so that the movement sub-assembly reassumes the position shown in FIG. 1. The seal 5 is then removed, which can be done without damaging it, as its material is flexible and the sub-assembly is removed by turning over the middle-bezel 1.

As a variation, it would be possible to provide a longer threading in the opening 14 and to secure the ring 10 by means of a threaded ring screwed in opening 14. The sealing pressure could thus be obtained, and the movement sub-assembly fixed in the case, without action by the back. This may facilitate certain operations such as regulation and securing of a winding stem.

What is claimed is:

1. A watch case, comprising;

A middle-bezel having, as an integral part thereof, an inwardly-directed collar defining a non-circular upper opening, the collar having a generally flat lower collar face;

a watch glass receivable in the non-circular upper opening, being of a corresponding non-circular shape, and having an outwardly-directed peripheral glass flange dimensioned to pass with slight play through the non-circular upper opening in the middle-bezel;

a packing seal having an outer part disposed under the collar and an inner part on and coextensive with the glass flange; and means for applying pressure to the glass to compress the seal between the collar and the glass flange, whereby the glass can be inserted in the middle-bezel through the upper opening, and can be held in the upper opening by the compressing of the seal.

2. A watch case according to claim 1 in which the middle-bezel has, opposite the upper opening, a smaller, circular, lower, threaded opening; the pressure-appplying means comprising an element insertable in the lower opening.

3. A watch case according to claim 2 in which said element comprises a back threaded into the lower opening.

4. A watch case according to claim 2 in which said element comprises a ring axially insertable in the lower opening.

5. A watch case according to claim 4 in which the ring comprises an upper part receivable through the non-circular upper opening, being of a corresponding non-circular shape and being dimensioned to pass with slight play through the non-circular upper opening, and a lower circular part receivable in the lower opening.

6. A watch case, comprising;

a middle-bezel having, as an integral part thereof, an inwardly-directed collar defining a non-circular upper opening, the collar having a generally flat lower collar face, and the middle-bezel also having smaller, circular, lower opening;

a watch glass receivable in the non-circular upper opening; being of a corresponding non-circular shape, and having an outwardly-directed peripheral glass flange dimensioned to pass with slight play through the non-circular upper opening in the middle-bezel, the flange having a generally flat upper flange face and the glass also having, upwardly extending from the upper flange face, a bevelled, upwardly converging outer glass face;

a packing seal having an outer part disposed under the collar and an inner part coextensively disposed on the glass flange and having a bevelled, upwardly converging inner face generally conforming to the bevelled, outer glass face; and means for applying pressure to the glass to upwardly-outwardly compress the seal between the collar and the glass flange and outer glass face, whereby the glass can be inserted in the middle-bezel through the upper opening, and can be held in the upper opening by the upward-outward compressing of the seal.

* * * * *